US009903621B1

(12) United States Patent
Goel et al.

(10) Patent No.: US 9,903,621 B1
(45) Date of Patent: Feb. 27, 2018

(54) COOLING SYSTEM WITH THERMAL BATTERY

(71) Applicant: Inficold Inc., Saratoga, CA (US)

(72) Inventors: Nitin Goel, Ghaziabad (IN); Himanshu Pokharna, Saratoga, CA (US); Sagar Khiyani, Jhansi (IN)

(73) Assignee: Inficold Inc., Saratoga, CA (US)

( * ) Notice: Subject to any disclaimer, the term of this patent is extended or adjusted under 35 U.S.C. 154(b) by 0 days.

(21) Appl. No.: 15/471,574

(22) Filed: Mar. 28, 2017

(51) Int. Cl.
*F25B 25/00* (2006.01)
*F25B 49/02* (2006.01)

(52) U.S. Cl.
CPC ..... *F25B 25/005* (2013.01); *F25B 49/02* (2013.01); *F25B 2341/0661* (2013.01); *F25B 2400/0403* (2013.01); *F25B 2400/0409* (2013.01); *F25B 2400/13* (2013.01); *F25B 2400/24* (2013.01); *F25B 2500/05* (2013.01); *F25B 2600/2501* (2013.01)

(58) Field of Classification Search
CPC ..... F54F 5/0021; F54F 5/0025; F54F 2005/0025; F54F 2005/032; F24F 5/0021; F24F 5/0025; F24F 2005/0025; F24F 2005/032
See application file for complete search history.

(56) References Cited

U.S. PATENT DOCUMENTS

| | | | | |
|---|---|---|---|---|
| 5,211,029 | A * | 5/1993 | Uselton | F24F 5/0017 62/324.5 |
| 6,105,659 | A | 8/2000 | Pocol et al. | |
| 6,220,337 | B1 | 4/2001 | Chen et al. | |
| 6,763,671 | B1 | 7/2004 | Klett et al. | |
| 2009/0205590 | A1 | 8/2009 | Vetrovec | |
| 2009/0293862 | A1 | 12/2009 | Bailey | |

* cited by examiner

*Primary Examiner* — Cassey D Bauer
(74) *Attorney, Agent, or Firm* — Bookoff McAndrews PLLC

(57) ABSTRACT

A cooling system includes an evaporator unit, a condensing unit, and a thermal battery fluidly coupled to the evaporator unit and the condensing unit. The cooling system also includes a control system configured to selectively direct a fluid refrigerant between any two of the condensing unit, the evaporator unit, and the thermal battery.

20 Claims, 12 Drawing Sheets

COOLING SYSTEM WITH THERMAL BATTERY

BACKGROUND

Worldwide demand for cooling and refrigeration systems are rising exponentially. Driven by a warming planet and a rapidly expanding middle class in developing economies, the use of cooling systems (e.g., air conditioners, cold storage units, beverage coolers, bulk milk coolers, etc.) is surging. In most countries, energy consumed by cooling systems account for a substantial portion of the total power used. Almost all current cooling systems operate on the vapor-compression thermodynamic cycle, where a circulating liquid refrigerant absorbs and removes heat from a cooled space (such as, for example, an enclosed room, cabinet, etc.), and rejects the heat elsewhere. However, such cooling systems consume large amounts of power. A recent intergovernmental study estimates that power consumption for residential air conditioning alone will increase over thirty-fold by the year 2100.

Furthermore, cooling systems (such as air conditioners) in a geographic area tend to turn on at the same time causing a surge in power use. To accommodate this demand surge, utilities in developed countries use "pecker plants" (gas turbines, etc.) which can provide instantaneous power at a significantly higher cost. Since consumers are unwilling to pay the higher rates, many parts of the developing world encounter blackouts as the demand exceeds supply. To reduce the cost of peak power, and the inconvenience of blackouts, it is desirable to shift some of the high electricity loads to non-peak time (e.g., morning, night, etc.). One way to accomplish this is by storing the energy needed to operate the cooling systems in batteries. However, electric battery cost is very high. Embodiments of the current disclosure provide systems and methods to alleviate some of these deficiencies. The scope of the current disclosure, however, is defined by the attached claims, and not by the ability to solve any specific problem.

SUMMARY

Embodiments of the present disclosure relate to cooling systems and methods of using such cooling systems. Each of the embodiments disclosed herein may include one or more of the features illustrated and described in connection with any of the other embodiments.

In one embodiment, a cooling system is disclosed. The cooling system may include an evaporator unit, a condensing unit, and a thermal battery fluidly coupled to the evaporator unit and the condensing unit. The cooling system may also include a control system configured to selectively direct a fluid refrigerant between any two of the condensing unit, the evaporator unit, and the thermal battery.

In another embodiment, a method of operating a cooling system is disclosed. The cooling system may include an evaporator unit positioned in a space, a condensing unit, a thermal battery fluidly coupled to the evaporator unit and the condensing unit, and a control system configured to operate the cooling system. The method may include directing a refrigerant from the condensing unit to the evaporator unit when an energy cost is less than or equal to a threshold cost value, and directing the refrigerant from the condensing unit to the thermal battery when an ambient temperature of the space is less than or equal to a threshold temperature value.

In yet another embodiment, a cooling system is disclosed. The cooling system may include an evaporator unit positioned in a cooling space, a condensing unit, and a thermal battery. The thermal battery may include (a) a housing, (b) a coolant in the housing, and (c) a heat exchanger at least partially submerged in the coolant. The cooling system may also include a fluid refrigerant configured to flow through the evaporator unit, the condensing unit, and the heat exchanger of the thermal battery in a closed loop. The cooling system may also include one or more control valves fluidly coupling the condensing unit, the evaporator unit, and the thermal battery, and a control system configured to control the one or more control valves to selectively direct the refrigerant between (i) the condensing unit and the evaporator unit, (ii) the condensing unit and the thermal battery, and (iii) the thermal battery and evaporator unit, based on at least one of an energy cost and an ambient temperature of the cooling space

BRIEF DESCRIPTION OF DRAWINGS

The accompanying drawings, which are incorporated in and constitute a part of this specification, illustrate exemplary embodiments of the present disclosure. In these drawings, where appropriate, reference numerals illustrating similar elements are labeled similarly. For simplicity and clarity of illustration, the figures depict the general structure and/or manner of construction of the various embodiments. Descriptions and details of well-known components, features, and techniques may be omitted to avoid obscuring other features. Elements in the figures are not necessarily drawn to scale. The dimensions of some features may be exaggerated relative to other features to improve understanding of the exemplary embodiments. For example, one of ordinary skill in the art appreciates that schematic views and cross-sectional views are not drawn to scale and should not be viewed as representing proportional relationships between different components. Further, even if it is not specifically mentioned in the text, aspects described with reference to one embodiment may also be applicable to, and may be used with, other embodiments.

DETAILED DESCRIPTION

In the description below, a few exemplary embodiments of the current disclosure are described with reference to an air conditioning system. However, it should be understood that the disclosure is not limited thereto. Rather, applying the principles described, the systems and methods of the present disclosure may be used in any cooling system application. Non-limiting examples of such cooling system applications include commercial refrigeration systems, cold storages, beverage coolers, bulk milk coolers, wine coolers, egg yolk coolers, refrigerated transport trucks etc. In this disclosure, relative terms, such as "about," "substantially," or "approximately" are used to indicate a possible variation of ±10% of a stated value.

Figure 1:
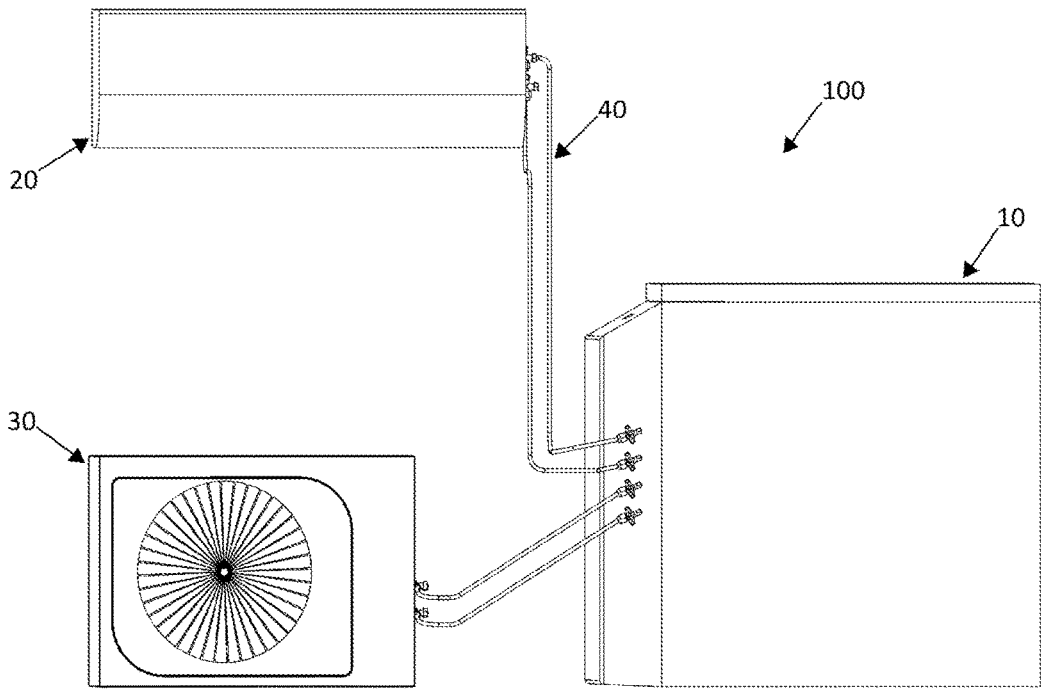
FIG. 1 illustrates an exemplary cooling system of the current disclosure.

FIG. 1 illustrates an exemplary cooling system, in the form of a cooling system 100. Cooling system 100 includes an outdoor unit 30 and an indoor unit 20. Typically, the indoor unit 20 is positioned in a cooled space (e.g., a room, refrigerator/cooler cabinet, etc.) for cooling the air in the space, and the outdoor unit 30 is positioned external to the cooled space (e.g., outside the room, outside the cabinet, etc.). However, this is not a requirement. In some embodiments, both the indoor and the outdoor units may be positioned in the same space.

The outdoor unit 30 may include a compressor and a condenser, and the indoor unit 20 may include an evaporator (e.g., a liquid-to-air or an air-air heat exchanger), similar to those found in typical AC units. The outdoor unit 30 and the indoor unit 20 may, in some cases, be simply referred to as the "condensing unit" and the "evaporating unit" respectively. One or more (e.g., a pair) tubes or conduits may fluidly couple the indoor unit 20 and the outdoor unit 30. A fluid (liquid or gaseous) refrigerant 40 may circulate between the outdoor and the indoor units 20, 30 to transfer heat between the two components. Any type of refrigerant 40 may be circulated between units 20 and 30. In some embodiments, a known hydro-fluorocarbon (HFC) based refrigerant (such as R22, R-410A, R-407C, R-134a), carbon dioxide, or a hydrocarbon based compound may be used as refrigerant 40. It should be noted that, although the outdoor unit 30 is described as having a single compressor and a single condenser, and the indoor unit 20 is described as having a single evaporator, this is only exemplary. In some embodiments, multiple compressors and/or condensers may be provided in an exemplary outdoor unit 30, and multiple evaporators may be provided in an exemplary indoor unit 20.

Figure 2:
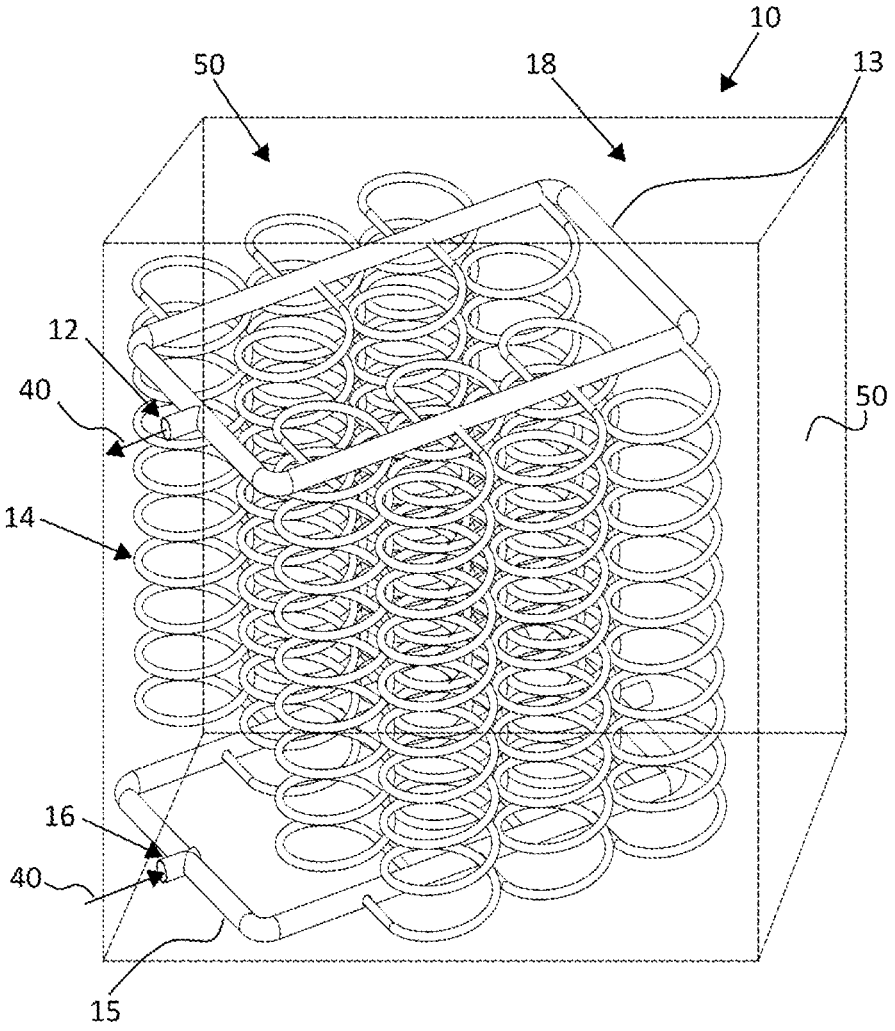
FIG. 2 is an illustration of heat exchangers of an exemplary thermal battery of the cooling system of FIG. 1.

A thermal battery 10 is fluidly coupled to the outdoor unit 30 and the indoor unit 20. The thermal battery 10 is a device used for storing and releasing thermal energy. The thermal battery 10 allows energy available at one time to be temporarily stored and then released at another time. FIG. 2 illustrates an exemplary embodiment of the thermal battery 10. Thermal battery 10 may include a housing 18 containing a coolant 50 and a heat exchanger submerged (at least partially) in the coolant 50. While in use, the refrigerant 40 of the cooling system 100 may pass through the tubes of the heat exchanger and transfer heat to (or from) the coolant 50. The coolant 50 may be any type of material that can store and release thermal energy. In some embodiments, water may be used as coolant 50. In some embodiments, a salt-based or alcohol-based coolant 50 may be used. As the refrigerant 40 flows through the thermal battery 10, the coolant 50 absorbs thermal energy from, or releases thermal energy to, the refrigerant 40 depending upon the temperature difference between the refrigerant 40 and the coolant 50. When the refrigerant 40 is colder than the coolant 50, the refrigerant 40 absorbs heat from the coolant 50, and when the coolant 50 is colder than the refrigerant 40, the coolant 50 absorbs heat from the refrigerant 40. In some embodiments, the coolant 50 may be a phase-change material. A phase-change material enables more energy to be stored and released due to its latent heat of fusion or latent heat of vaporization. In some embodiments, additives may be added to the coolant 50 to impart desired properties to the coolant 50. These additives may include compounds such as, for example, corrosion inhibitors, organic material growth inhibitors, antifreeze agents, materials that lower the freezing temperature, etc., or combination thereof.

In general, the housing 18 may be made of any metallic (copper, steel, aluminum, stainless steel etc.) or non-metallic (plastic, etc.) material. In some embodiments, the walls of the housing 18 may include insulation to reduce heat exchange of the coolant 50 with air outside the housing 18. The walls of the housing 18 may be rigid or flexible. In some embodiments, the walls may be expandable (or have some flexibility) to allow the coolant 50 to freeze without increasing the stresses in the housing 18. In some embodiments, materials such as foams may be provided in the housing 18. For example, foams may be incorporated into one or more walls of the housing 18. The foams may allow the housing 18 to accommodate the increase in volume of the coolant 50 when it changes phase, or freezes. The thermal battery 10 may be positioned outdoors (with the outdoor unit 30) or indoors (with the indoor unit 20). In some embodiments, the thermal battery 10 may not be a separate unit, but may be incorporated with the indoor and/or the outdoor unit 20, 30.

The heat exchanger of the thermal battery 10 may include tubes or pipes 14 extend through the coolant 50 between a first conduit 12 and a second conduit 16. In use, these pipes 14 may extend through and may be submerged in the coolant 50. The first conduit 12 and the second conduit 16 may direct the refrigerant 40 (circulating between the indoor and outdoor unit 20, 30) through the pipes 14 submerged in the coolant 50. As the refrigerant 40 passes through the pipes 14 that are surrounded by the coolant 50, heat transfer occurs between the refrigerant 40 and the coolant 50. The refrigerant 40 may enter the housing 18 through the second conduit 16 (or the first conduit 12) and leave the housing 18 through the first conduit 12 (or the second conduit 16). In some embodiments, the pipes 14 may extend between two headers 13, 15 positioned on either side of the pipes 14. In such embodiments, the second conduit 16 may direct the refrigerant 40 into the header 15. The refrigerant 40 may then enter the pipes 14 through the header 15 and exit the pipes 14 through the header 13. The headers 13, 15 may allow the refrigerant flowing into the thermal battery 10 to evenly flow through all the pipes 14 and thus improve heat transfer between the refrigerant 40 and the coolant 50.

In some embodiments, the pipes 14 may be configured to increase the surface area (of the pipes 14) exposed to the coolant 50. Increasing the surface area of the pipes 14 increases the heat transfer between the coolant 50 outside the pipes 14 and the refrigerant 40 inside the pipes 14. In some embodiments, the surface area may be increased by configuring the pipe as coils (as illustrated in FIG. 2) or another structure which increases the distance the refrigerant 40 travels through the coolant 50. In some embodiments, the surface area of the pipes 14 in contact with the coolant 50 may be increased by providing surface area increasing structures (such as, for e.g., fins, pins, dimples, or other surface irregularities) on the surface of the pipes 14 in contact with the coolant 50. The pipes 14 may be made of any heat conductive material (copper, steel, aluminum, stainless steel etc.). In some embodiments, the pipes 14 and the housing 18 may include coating (anti-corrosion coating, etc.) to impart desirable properties to the material. Although not illustrated, in some embodiments, the housing 18 (and/or the conduits) may also include flow circulation devices (impellers, pumps, etc.) to circulate the coolant 50 in the housing 18. The flow circulation device may be positioned within the housing 18 or outside the housing 18. In some embodiments, the housing 18 may also include safety devices (release valves, etc.) to control the conditions (pressure, temperature, etc.) in the housing 18, and sensors to monitor these conditions. These sensors may include an frozen coolant sensor (e.g., a sensor that measures the quantity of frozen coolant in the thermal battery 10), or another type of sensor that measures the cooling capacity of the thermal battery 10, for example, by measuring the temperature, volume or level of the coolant. For water based coolants, the change in volume of the coolant due to liquid-solid phase change can be calibrated to measure the battery cooling capacity (or battery charge level).

Figure 3A:
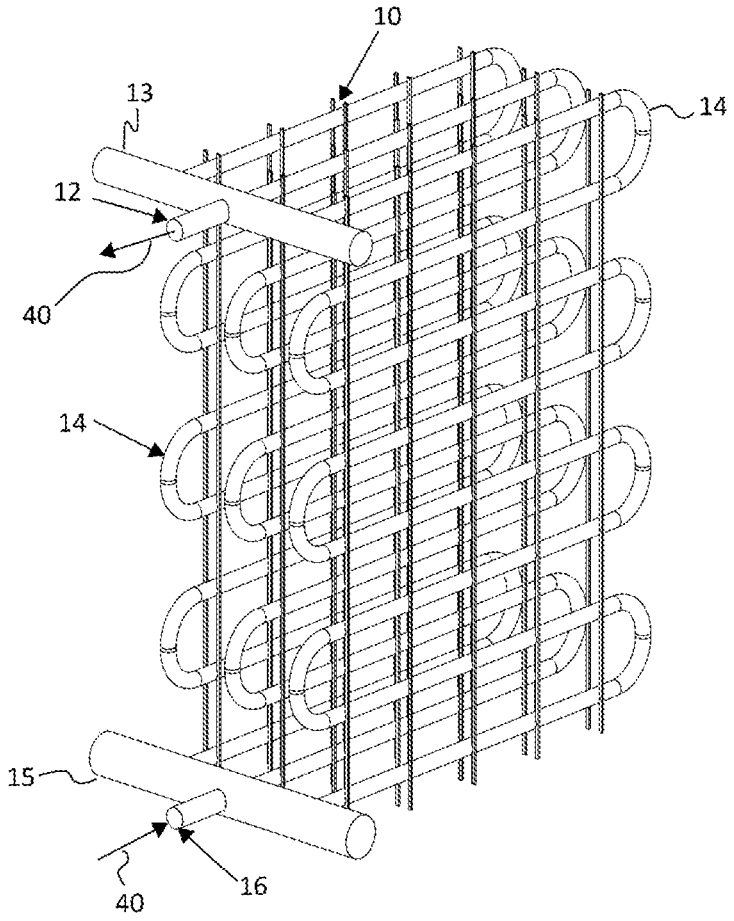
FIGS. 3A-3C are illustrations of heat exchangers of other exemplary thermal batteries of the cooling system of FIG. 1.
Figure 3B:
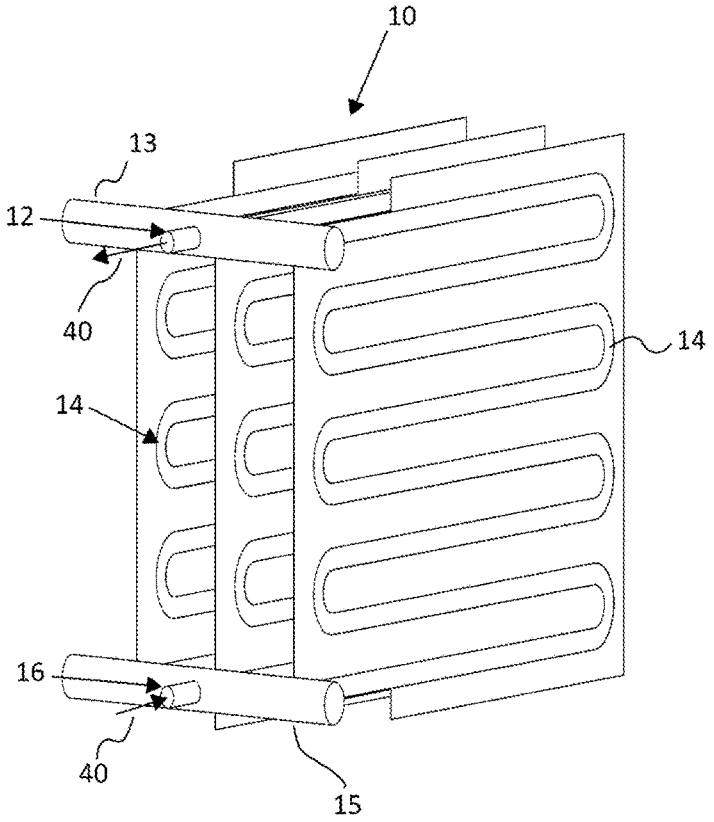

It should be noted that the thermal battery 10 illustrated in FIG. 2 is only exemplary. In general, the thermal battery 10 may have any structure and shape. FIGS. 3A and 3B illustrate other exemplary embodiments of the heat exchanger portion of thermal batteries. In FIGS. 3A and 3B, the housing 18 and the coolant 50 which would normally exist around the heat exchanger portion of the thermal battery 10 has been removed for improved visibility. As illustrated in FIG. 3A, in some embodiments, the pipes 14 may have a wavy, sinusoidal shape with major portions extending in a horizontal direction. Pipes 14 may include extended surface "fins" attached thereto. The fins may be metal plates, rods or rods/bars of other materials/shapes. In some embodiments, as illustrated in FIG. 3B, plates may connect the pipes 14 for increased structural rigidity and to improve heat transfer between the coolant 50 and the refrigerant 40. In some embodiments, these plates may be made of a metal (e.g., aluminum) and may be fused together for making an integral tubular structure 14 to form a refrigerant path through it (e.g. roll bond heat exchangers). As discussed with reference to FIG. 2, the second conduit 16 (of the thermal batteries 10 of FIGS. 3A and 3B) may direct the refrigerant 40 into the battery 10 via the header 15 and remove the refrigerant 40 from the battery 10 via the header 13.

Figure 3C:
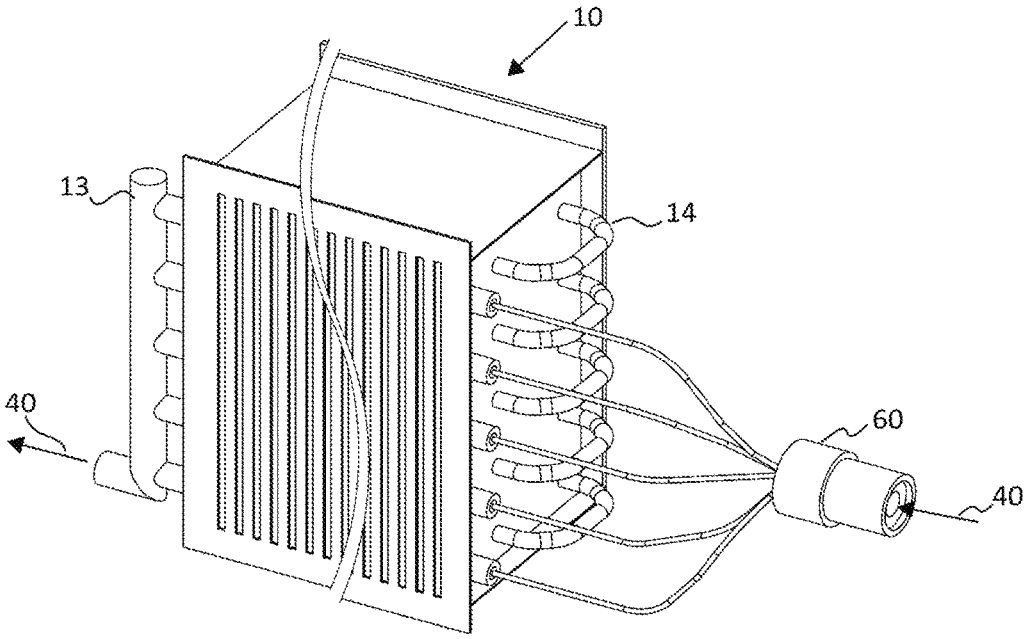

In some embodiments, as illustrated in FIG. 3C, in addition to or alternative to header 13 (and/or header 15), a fluid distributor 60 may be provided in the second conduit 16 to uniformly distribute the liquid refrigerant 40 into the different parallel paths (or pipes 14) of the thermal battery 10. Providing a distributor 60 may be beneficial in large cooling systems. In small cooling system, the header 15 may itself act as a distributor. However, as the coolant 50 in the battery 10 begins to transform into frozen coolant, a small initial non-uniformity in the flow of the refrigerant 40 through the pipes 14, or mal-distribution, may eventually become quite large. Initially, the non-uniformity in the distribution may be lower as all parallel paths (or pipes 14) are submerged in the liquid coolant 50. As frozen coolant begins to form around some of the pipes 14, the liquid refrigerant 40 may preferentially flow through the pipes 14 which are surrounded by frozen coolant than the other pipes 14, and lead to a greater non-uniform distribution. Providing a distributor 60 may reduce the non-uniformity by more evenly distributing the refrigerant 40 through the pipes 14 of the battery 10.

Figure 4:
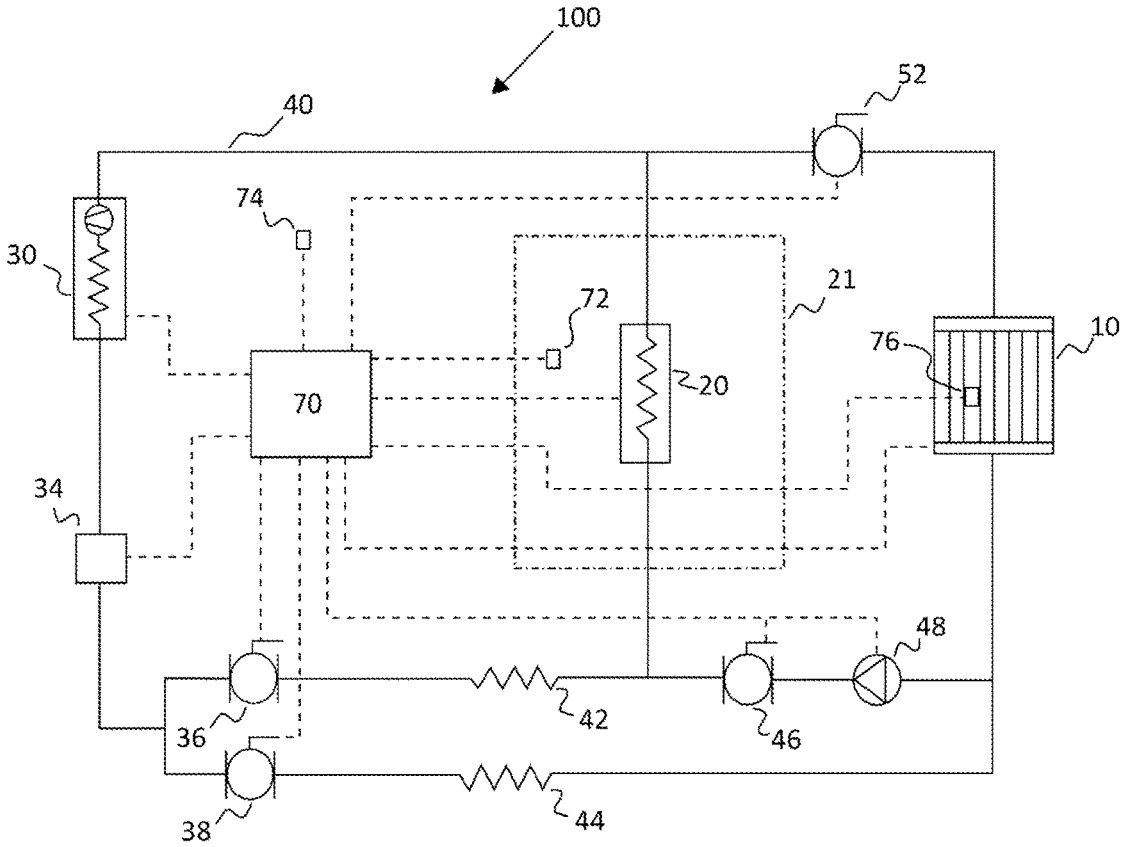
FIG. 4 is a schematic illustration of the cooling system of FIG. 1.

FIG. 4 is an exemplary schematic view of the cooling system 100 of FIG. 1. In system 100, conduits (not labeled) direct the refrigerant 40 between the indoor unit 20, the outdoor unit 30, and the thermal battery 10. In FIG. 4, the indoor unit 20 is illustrated by a box positioned in a cooled space 21 (such as, a room, cabinet, insulated chamber, milk/beverage/chemical/juice tank etc.). The outdoor unit 30 (or condensing unit) includes a compressor and a condenser and the indoor unit 20 (or evaporating unit) includes an evaporator. The compressor draws in cool, low-pressure refrigerant 40 and compresses the refrigerant 40 thereby increasing its pressure and temperature. The high-pressure, high temperature, refrigerant 40 from the compressor enters the condenser. In the condenser, the hot refrigerant 40 is cooled and condensed by transferring the heat to external environment such as air, liquid or ground. The refrigerant 40 leaves the condenser as a medium temperature, high pressure, liquid enters an expansion valves 42, 44. In some embodiments, a receiver tank 34 (or a reservoir) may be positioned downstream of the outdoor unit 30 to store excess refrigerant 40. The expansion valves 42, 44 may be a thermostatic or electrostatic expansion valve or another type of known expansion device (e.g., a throttling valve, capillary tube, etc.). The expansion valves 42, 44 is a flow-restricting device that causes a pressure drop (and resulting temperature drop) in the refrigerant 40. The cooled refrigerant 40 from the expansion valves 42, 44 passes through the evaporator of the indoor unit 20, or the thermal battery 10, to absorb heat and produce cooling (in the cooled space associated with the indoor unit 20 or the coolant 50 of the thermal battery 10).

Control valves (e.g., valves 36, 38, 46, 52) are provided in the conduits of system 100 to selectively direct the refrigerant 40 between different components. The valves 36, 38, 46, 52 may be of the same type or may be of different types. In some embodiments, at least some of the valves may be electronically controlled. That is, some or all of the valves in system 100 may be actuated in response to commands (or signals) from a control system. In some embodiments, at least some of the valves 36, 38, 46, 52 may be bi-directional valves (i.e., valves that can stop or modulate flow in both directions). Any type of bidirectional valve (ball valve, poppet valve, needle valve, knife-gate valve, butterfly valve, etc.) may be used in system 100. In some embodiments, ball valves may be used as valves 36, 38, 46, 52. It is also contemplated that, in some embodiments, some of the valves (e.g., valves 36, 46, and 52) may be ball valves while the other valves (e.g., valve 38) may be another type of valve (unidirectional or bi-directional valve).

In some embodiments, using these valves, the refrigerant 40 in system 100 may be selectively directed to flow between any two of the indoor unit 20, outdoor unit 30, and the thermal battery 10. As will be discussed in more detail below, by selectively directing the flow between these components, the cooling system 100 may operate in several modes. In some embodiments, these modes may include a charging mode, a direct cooling mode, and a discharge mode. A control system 70 may switch the cooling system 100 between these different modes based on input from a user, or automatically based on operating conditions (relative temperatures at different regions, energy cost, etc.) of the system 100. As is known in the art, the control system 70 may include electronic circuits and/or integrated circuit devices (processor, memory, etc.) that may be adapted to store and run algorithms to control the system based on inputs received from sensors and users. The control system 70 may also include user input devices (keyboard, display, etc.) that enable a user to interact with the control system 70. In some embodiments, the control system 70 may be compatible with internet-of-things protocols, and may be adapted to be controlled by a user over the internet using a smart-phone or another such device. Control system 70 may be operatively coupled to the different components (indoor unit 20, outdoor unit 30, thermal battery 10, valves, etc.) of the cooling system 100 and to sensors 72, 74, 76 that are configured to measure/detect the operating conditions (environmental conditions, energy costs, time of day, etc.). Based on input from one or more of the components and sensors, the control system 70 may switch between the different operating modes of the cooling system 100.

Figure 5A:
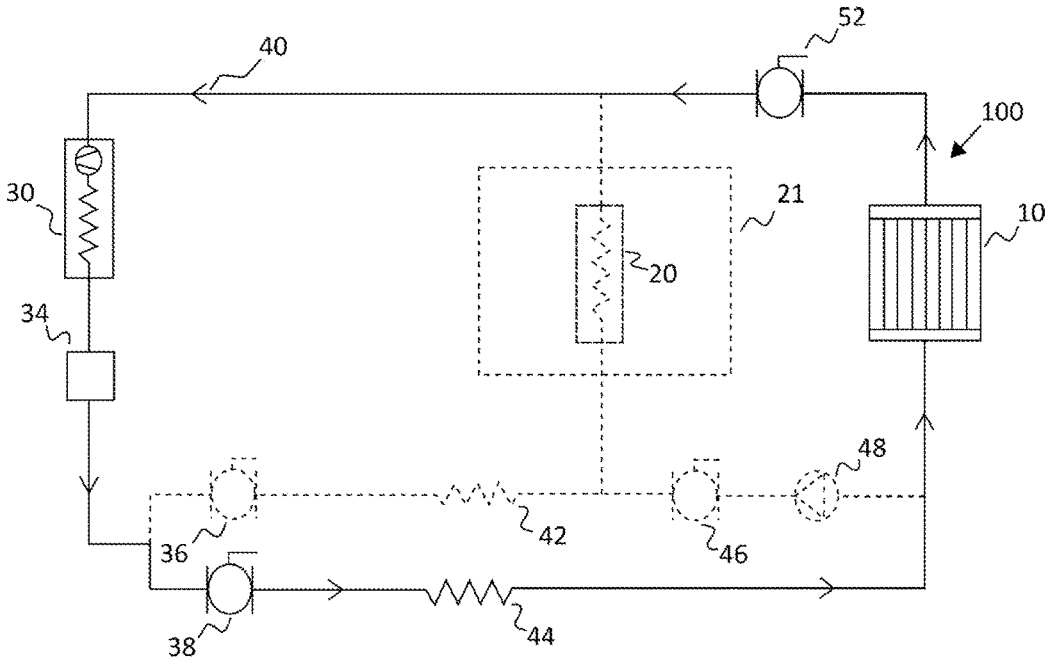
FIG. 5A is a schematic illustration of the cooling system of FIG. 1 operating in a charging mode.
Figure 5B:
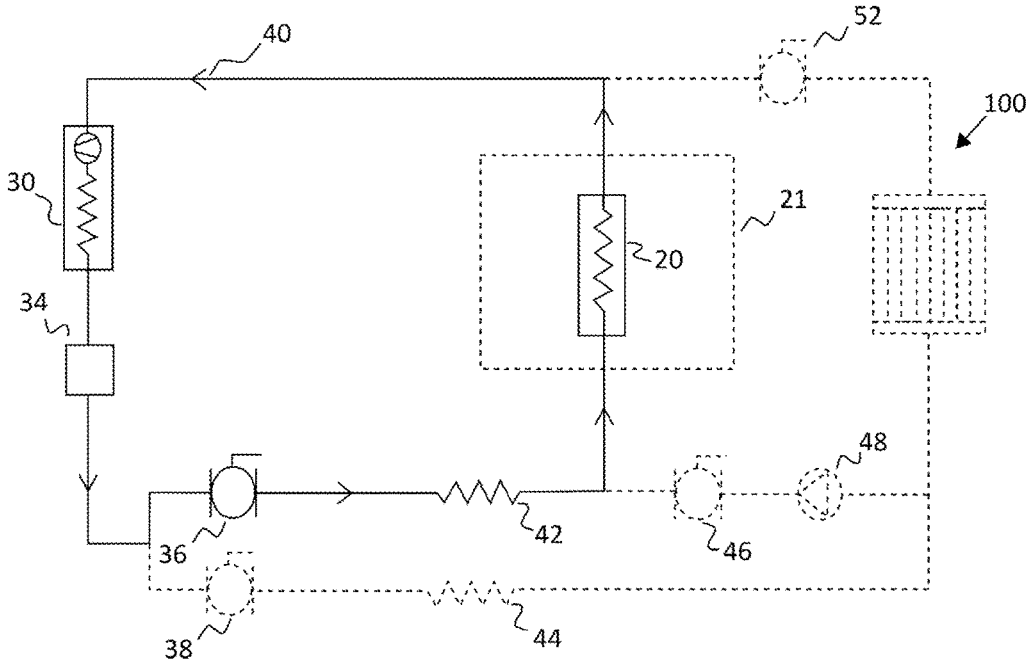
FIG. 5B is a schematic illustration of the cooling system of FIG. 1 operating in a direct cooling mode.
Figure 5C:
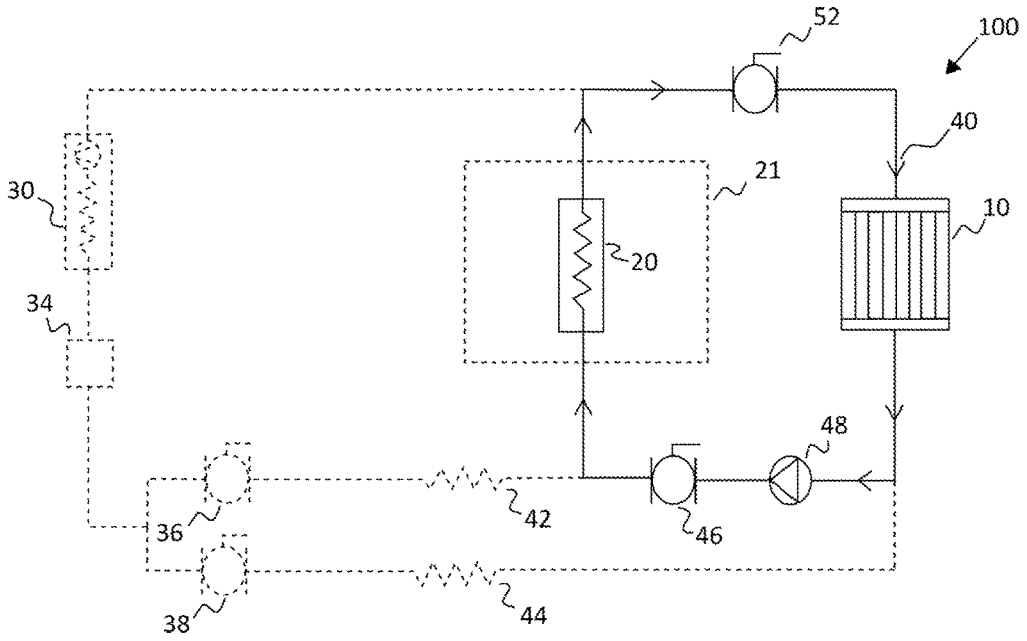
FIG. 5C is a schematic illustration of the cooling system of FIG. 1 operating in a discharge mode.

FIGS. 5A, 5B, and 5C are exemplary schematic illustrations of the cooling system 100 in the charging mode, the direct cooling mode, and the discharge mode, respectively. In FIGS. 5A-5C, the conduits and components in the refrigerant flow path are illustrated using solid lines, and components and conduits that are not in the refrigerant flow path are illustrated using dashed lines. The control system 70 and its associated connections (shown in FIG. 4) are not shown in these figures for the sake of clarity. With reference to FIG. 5A, in the charging mode, the refrigerant 40 is circulated between the outdoor unit 30 and the thermal battery 10. To operate in this mode, valve 36 is closed to direct the high-pressure high temperature refrigerant 40 from the outdoor unit 30 to expansion valve 44 via valve 38. The expansion valve 44 expands the refrigerant 40 and directs the low-pressure low temperature refrigerant to the thermal battery 10. As the chilled refrigerant 40 flows through the pipes 14 (that are submerged in the coolant 50) of the thermal battery 10, heat is transferred from the coolant 50 to the refrigerant 40, thereby cooling the coolant 50. In some embodiments, the heat transfer between the coolant 50 and the refrigerant 40 may cause the coolant 50 to freeze. The warmed refrigerant 40 from the thermal battery 10 then flows to the outdoor unit 30 to continue its cycle. The control system 70 may switch the cooling system 100 into the charging mode when electricity is available (or cheaply available) but cooling is not needed in the cooled space.

FIG. 5B illustrates the cooling system 100 in the direct cooling mode. In this mode, the control system 70 closes valves 38, 46 and 52 and opens valve 36 to direct the refrigerant 40 from the outdoor unit 30 to expansion valve 42 and the indoor unit 20. In the indoor unit 20, warm air in the cooled space (or a warm fluid (milk, beverage, etc.) in an enclosed space) is cooled through the evaporator of the indoor unit 20. As the air flows through the indoor unit 20, the air is directed over chiller pipes through which the cooled refrigerant 40 circulates. Heat from the air is transferred to the refrigerant 40 passing through the chiller pipes to cool the air. The warmed refrigerant 40 from the evaporator flows into the compressor of the outdoor unit 30 to continue its cycle. The control system 70 may switch the cooling system to the direct cooling mode when electricity is cheaply or freely available and room cooling is desired.

FIG. 5C illustrates a schematic of the system 100 operating in the discharge mode. In this mode, refrigerant 40 is circulated between the thermal battery 10 and the indoor unit 20. To switch the system 100 to the discharge mode, the control system 70 may close valves 36 and 38 and open valves 46 and 52 to direct the coolant from the thermal battery 10 to the indoor unit 20. A pump 48 in the refrigerant flow path may be used to pump the refrigerant 40 between the thermal battery 10 and the evaporator in the indoor unit 20. In this mode, the refrigerant 40 may enter thermal battery 10 through the first conduit 12 (see FIG. 2) and leave through the second conduit 16 (i.e., enter through the top and leave through the bottom). This mode is activated when the power is expensive, or not available, and cooling of the cooled space 21 is required. As the refrigerant 40 flows through the thermal battery 10, the refrigerant 40 is cooled using the chilled (or frozen) coolant 50 (which was previously cooled during the charging mode) in the thermal battery 10. This cooled refrigerant is then used to cool air or fluid of the cooled space while flowing through the evaporator of the indoor unit 20.

It should be noted that, although the direct cooling mode of the cooling system 100 is described as being used when power is cheap, and the discharge mode is described as being used when power is expensive, this is only exemplary. In general, the cooling system 100 may be switched between its different modes based on any criterion. In some embodiments, when electric power is available from the utility grid, the cooling system 100 may be operated in the direct cooling mode, and when power is not available from the utility grid, the cooling system 100 may be operated in the discharge mode. For example, when the cooling system 100 is used to cool the cargo area of a refrigerated truck, the system may be operated in the direct cooling mode when the truck is parked (e.g., in a depot), and there is access to grid power. In such an application, the cooling system 100 may be switched to, and operated in, the discharge mode when the truck moves. In another example, where electricity generated by a solar panel array (or another alternative energy source) supplements the power delivered to a facility with a cooling system 100, the cooling system 100 may be operated in the direct cooling mode during the hours when the solar panels are producing power (or when power is available from the solar panel arrays), and in the discharge mode at times when the solar panels are not producing power. Other examples of times when the cooling system 100 operates in a selected mode (e.g., the discharge mode) include periods of time when a diesel generator or large electric batteries are being used to provide power, when demand charges are high, etc.

In some embodiments, in the direct cooling mode and the charging mode, the system 100 may operate in the traditional refrigeration cycle comprising compression of the refrigerant 40 to create a hot high pressure refrigerant in the compressor and condensation of this refrigerant 40 in the condenser of the outdoor unit 30 to cool the high-pressure refrigerant. However in some embodiments, there may be no compression and expansion in the discharge mode. Instead, the refrigerant 40 may pick up heat in the evaporator of the indoor unit 20 and convert into vapor (just like the traditional cycle). The vapor refrigerant 40 may then enter the pipes 14 of the thermal battery 10 to cool and change its phase to liquid. Thus, the physical phenomena during the discharge phase is primarily of two phase liquid cooling.

Figure 6A:
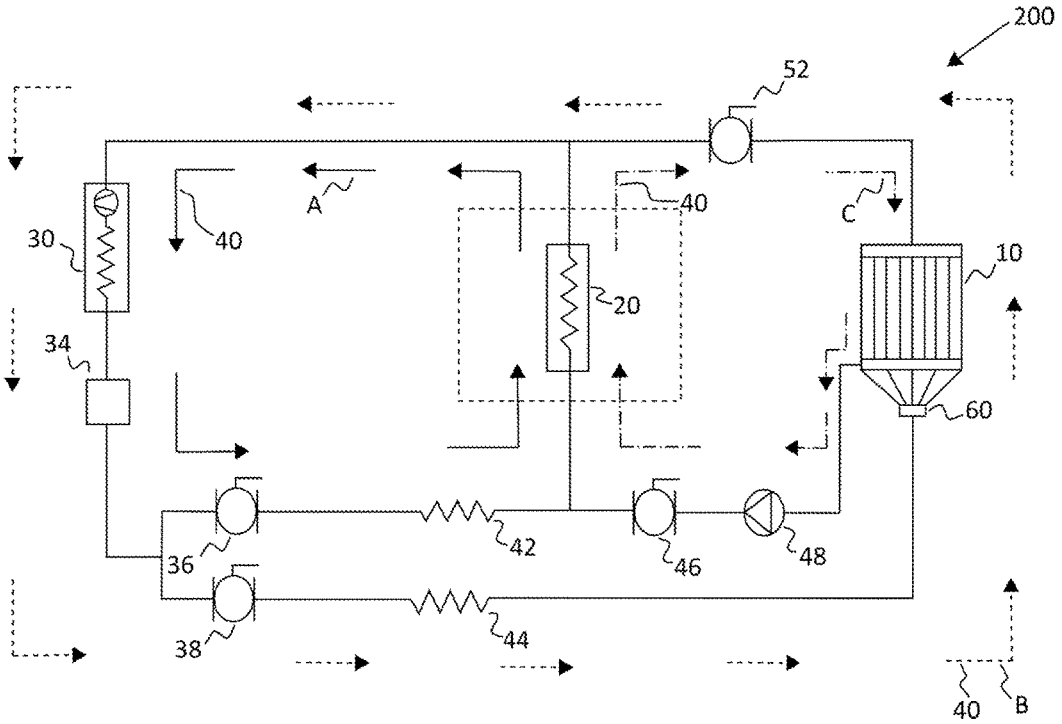
FIGS. 6A and 6B are schematic illustrations of other exemplary cooling systems of the current disclosure.

It should be noted that the components illustrated as being used in system 100 of FIG. 4 are only exemplary, and many variations are possible. For example, in some embodiments of the current disclosure, a thermal battery 10 with a fluid distributor 60 be used in place of the thermal battery of FIG. 4. FIG. 6A illustrates a schematic illustration of an exemplary cooling system 200 with such a thermal battery. In such embodiments, the fluid distributor 60 of the thermal battery 10 may assist in uniformly distributing the chilled liquid refrigerant 40 into the different parallel paths (or pipes 14) of the thermal battery 10. Providing such a distributor 60 may be beneficial in large cooling systems where relatively large thermal batteries may be utilized. Similar to system 100 of FIG. 4, when system 200 operates in the direct cooling mode, the control system (not shown in FIG. 6A) associated with system 200 selectively directs the refrigerant 40 from the outdoor unit 30 to the indoor unit 20 along the path indicated by Arrow A, and when operating in the charging mode, the control system redirects the refrigerant 40 flowing from the outdoor unit 30, along the path indicated by Arrow B, through the thermal battery 10. As this refrigerant flows through the expansion valve 44, it cools down. The fluid distributor 60 in the refrigerant flow path redistributes the chilled refrigerant flow through the different parallel paths within the thermal battery 10 to ensure uniform freezing of the coolant 50 therein. In the discharge mode, the control system activates the pump 48 (along with controlling other valves and components such as the compressor) to direct the refrigerant 40 from the thermal battery 10 into the indoor unit 20 along the path indicated by Arrow C. In some embodiments, as illustrated in FIG. 6A, a bypass conduit may be provided so that the refrigerant 40 can detour around the distributor 60 on its way to the indoor unit 20.

Embodiments of the cooling systems 100, 200 of the current disclosure may include components different from those illustrated and described. For example, as would be recognized by people skilled in the art, in addition to (or alternate to the illustrated components), the system 100 may include other components that are common in cooling systems. For example, some embodiments of the system 100 (or 200) may also include components such as filters, service valves, high pressure and low pressure switches, driers, pressure regulating valves, etc. positioned at suitable locations along the conduits. Since the operation of these components is known to people of skill in the art, for the sake of brevity, it is not discussed in more detail herein.

The specific layout (e.g., the physical arrangement of the conduits coupling the outdoor unit 30, the indoor unit 20, and the thermal battery 10, and the positioning of the valves and other components in these conduits) of systems 100 (of FIG. 4) and 200 (of FIG. 6A) are only exemplary. In general, cooling systems of the present disclosure may have any layout such that a control system can selectively direct a refrigerant 40 between (a) the outdoor unit 30 and the indoor unit 20 (direct cooling mode), (b) the outdoor unit 30 and the thermal battery 10 (charging mode), and (c) the thermal battery 10 and the indoor unit 20 (discharge mode) based on the operating conditions of the cooling system. That is, when energy cost is low, room cooling is provided by the outdoor unit 30, and when energy cost is high, room cooling is provided by the thermal battery 10. The thermal battery 10 is also charged by the outdoor unit 30 when room cooling is not required.

Figure 6B:
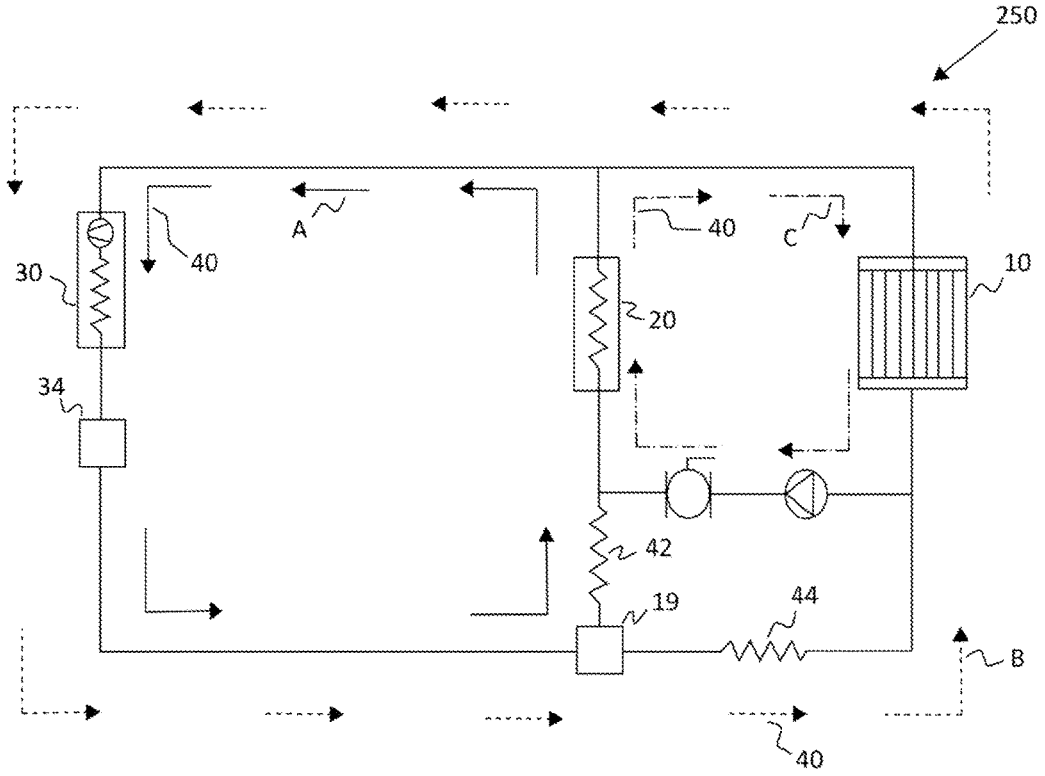

FIG. 6B illustrates a schematic view of another embodiment of a cooling system 250 configured to selectively direct a refrigerant between different components based on the operating conditions. When operating in the direct cooling mode, the control system (not shown in FIG. 6B) associated with system 250 controls a three way valve 19 to selectively direct the high-pressure refrigerant 40 from the outdoor unit 30 to the indoor unit 20 along the path indicated by Arrow A. The refrigerant 40 expands in the expansion valve 42, and cools, as it proceeds to the indoor unit 20. When operating in the charging mode, the control system controls the three way valve 19 to redirect the refrigerant 40 flowing from the outdoor unit 30 to flow into the thermal battery 10 via the expansion valve 44 (along the path indicated by Arrow B). When energy cost is high, the control system activates the discharge mode, where the pump 48 directs cold refrigerant 40 from the thermal battery 10 into the indoor unit 20 along the path indicated by Arrow C. In some embodiments, a bypass conduit (not shown) may also be provided to redirect the coolant from the three way valve 19 to the upstream side of the outdoor unit 30 in the discharge mode. It should be noted that, as in the case of systems 100 and 200 (of FIGS. 4 and 6A), only components needed to describe the operation of system 250 are illustrated in FIG. 6B. Other components needed for practical and effective implementation of the described system will be obvious to those skilled in the art, and are therefore not described.

It should be noted that although three distinct modes (direct cooling mode, charging mode, and discharge mode) are described above, this is only exemplary. In some embodiments, the cooling systems of the current disclosure may also operate in other modes, for example, in a combination of the above described modes. For example, in some embodiments, a portion of the compressed refrigerant 40 from the outdoor unit 30 may be directed to both the indoor unit 20 and the thermal battery 10. That is, a first portion of the compressed refrigerant 40 from the outdoor unit 30 may be directed to the indoor unit 20 via expansion valve 42, and a second portion of the compressed refrigerant 40 may be directed to the thermal battery 10 via expansion valve 44. In such an embodiment, the outdoor unit 30 is used to simultaneously cool both the cooled space and the thermal battery 10. The control system may control the ratio of the refrigerant 40 directed to the indoor unit 20 and the thermal battery 10 (i.e., the ratio of the first portion to the second portion) by controlling the three way valve 19 in system 250 of FIG. 6A (or valves 36 and 38 in systems 100 and 200 of FIGS. 4 and 6A). In some embodiments, this ratio may depend upon the operating conditions (indoor cooling requirements, amount of frozen coolant stored in thermal battery 10, etc.). Similarly, by selectively opening and closing the valves of the cooling system, in some embodiments, the cooled refrigerant 40 from expansion valve 42 and the cooled refrigerant 40 from the thermal battery 10 may both be directed to the indoor unit 20 for cooling.

With reference to system 100 of FIG. 4, the control system 70 selectively activates the different modes of the system 100 to improve efficiency and/or reduce cost. For example, when energy is less freely available or when energy charges are high (e.g., $Cost_{Energy} \geq$ a predetermined threshold cost value), the control system 70 may activate the discharge mode to cool the cooled space using the thermal battery 10. In most regions, energy cost is higher at certain times of the day (high-cost time period) and lower at other times of the day (low-cost time period). In such geographic regions, the control system 70 may activate the direct cooling mode when operating at a low-cost time period and automatically switch to the discharge mode when the time of day changes to a high-cost time period. In some embodiments, the system 100 may be switched to the discharge mode only if the thermal battery has sufficient retained cooling capacity. The retained cooling capacity of the thermal battery 10 may be measured by a sensor 76 (e.g., frozen coolant sensor, temperature sensor, volume sensor, etc.) embedded in the thermal battery 10. When the time of day changes to a low-cost time period, the control system 70 may switch the system 100 back to the direct cooling mode to provide cooling through the indoor unit 20 using refrigerant 40 from the outdoor unit 30.

When temperature sensors in the room (e.g., sensor 72) indicate that cooling of the cooled space is not necessary (i.e., when $T_{Room} \leq$ predetermined threshold temperature value) and/or when energy cost is low ($Cost_{Energy} \leq$ a threshold cost value), the control system 70 may activate the charging mode to redirect the refrigerant 40 to the thermal battery 10 to cool the coolant 50 therein. For example, when operating at a low cost time period and when $T_{Room} \leq$ a threshold temperature, the control system 70 may switch (e.g., periodically) the system 100 to the charging mode to make sure the thermal battery 10 is sufficiently charged. The threshold temperature and cost values may be selected by the user (e.g., by setting thermostat values, by preprogramming values into the control system 70, by wireless communication through Internet of Things into the control system 70, etc.).

Figure 7:
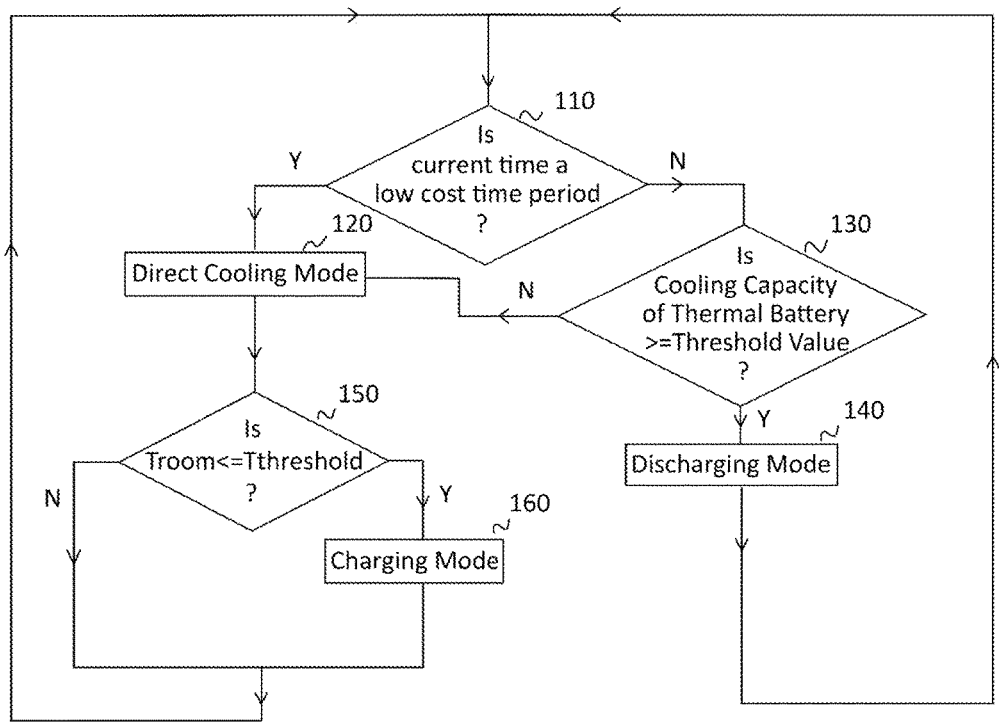
FIG. 7 is a flow chart illustrating an exemplary method of operating the cooling system of FIG. 1.

FIG. 7 is a flow chart that illustrates an exemplary method used by the control system 70 to switch a cooling system of the current disclosure (e.g., systems 100, 200, 250) between different modes. The control system 70 may first check to determine if the current time at the location where the cooling system 100 (200, 250) is installed is a low-cost time period (step 110). In some embodiments, the prevailing utility tariff schedule for the location may be programmed or wirelessly updated into the control system 70. In some embodiments, the user may enter (or select) the low-cost or high-cost time period in the control system 70. If the current time is a low-cost time period (step 110=Yes), the control system 70 may operate the cooling system 100 in the direct cooling mode (step 120). If the current time is not a low-cost time period (step 110=No), the control system 70 may check to determine if the thermal battery 10 has sufficient cooling capacity to be used to cool the cooled space (step 130). The control system 70 may check the cooling capacity of the thermal battery 10 in any manner. In some embodiments, the control system 70 may infer that the thermal battery 10 has sufficient cooling capacity if the amount of frozen coolant (or frozen material) stored in the thermal battery 10 is greater than or equal to a threshold value. In some embodiments, the control system 70 may determine the cooling capacity of the thermal battery 10 based on its temperature, level or volume.

If the cooling capacity of the thermal battery 10 is sufficient for the purpose (step 130=Yes), the control system 70 may operate the cooling system 100 in the discharge mode (step 140). However, if the control system 70 determines that the thermal battery cooling capacity is not sufficient for cooling the cooled space (step 130=No), direct cooling mode may be selected (step 120). In some cases, if the cooling capacity of the thermal battery 10 is not sufficient to cool the cooled space during a high-cost period (i.e., if step 130=No), the user may be notified (e.g., by a message on a display associated to the cooling system 100) and prompted to approve operating the cooling system 100 in the direct cooling mode before doing so. While operating in the direct cooling mode (step 120), the control system 70 may check to determine if the temperature of the cooled space is less than or equal to a threshold value (step 150). If it is, the cooling system 100 may be switched to the charging mode (step 160) to recharge the thermal battery 10 using refrigerant from the outdoor unit. As the system 100 operates, the control system 70 may continue to check the current time and compare the time with the prevailing utility tariff (step 110), to operate the cooling system 100 in a mode that increases efficiency and lowers cost. It should be noted that the method illustrated in FIG. 7 is only exemplary and many variations of this method are possible. For example, in some embodiments, a user may override the control system 70 and switch the cooling system 100 from one mode to another, for example, by pressing a button. Further, as described previously, operating the cooling system 100 in a selected mode based on the cost of energy (e.g., step 110 of FIG. 7) is only exemplary. In general, the operating mode of the cooling systems of the current disclosure may be selected based on any condition (e.g., time of day, availability of grid power/solar power/diesel power, etc.)

The control system 70 may activate the different modes of the cooling system 100 in any manner. In some embodiments, to switch from one mode to another, the control system 70 may control (activate, deactivate, vary the flow through, etc.) the valves 36, 38, 46, 52 to redirect the refrigerant 40 to selected parts of the system. In some embodiments, one or more components of the system 100 may also be activated or deactivated to switch between the different modes. For example, in some embodiments, the compressor of the outdoor unit 30 may be deactivated to switch the system 100 from one mode to another. For example, to switch from the charging mode (see FIG. 5A) to the discharge mode (see FIG. 5C), the control system 70 may keep valves 36, 38 closed (i.e., close a valve if it is open, or keep the valve closed if it is already closed), keep valves 46, 52 open (i.e., keep a valve open if it is already open, or open the valve if it is closed), and activate the pump 48 to redirect the refrigerant 40 from the thermal battery 10 to the indoor unit 20. In some embodiments, to switch from the charging mode to the discharge mode, the compressor of the outdoor unit 30 may first be deactivated, valves 36 and 38 may be closed and the pump 48 activated to operate the system in the discharge mode.

In some embodiments, to switch from the discharge mode to the direct cooling mode, the control system 70 may keep valves 38, 46 and 52 closed, keep valves 36 open, deactivate the pump 48, and activate the compressor of the outdoor unit 30 to redirect the refrigerant 40 along the desired new pathway.

To switch the cooling system from the direct cooling to the charging mode, valve 36 is closed and valves 38 and 52 are opened. The compressor (of the outdoor unit 30) which was activated in the direct cooling mode remains activated, and valve 46 which was closed in the direct cooling mode remains closed to redirect the refrigerant 40 along the desired new pathway.

Figure 8A:
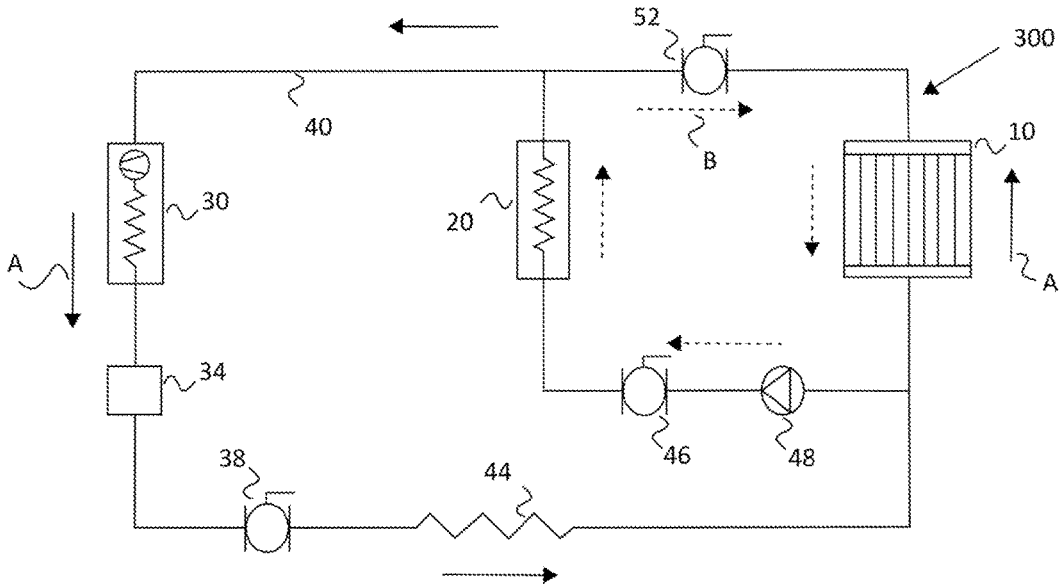
FIGS. 8A and 8B are schematic illustrations of other exemplary cooling systems of the current disclosure.
Figure 8B:
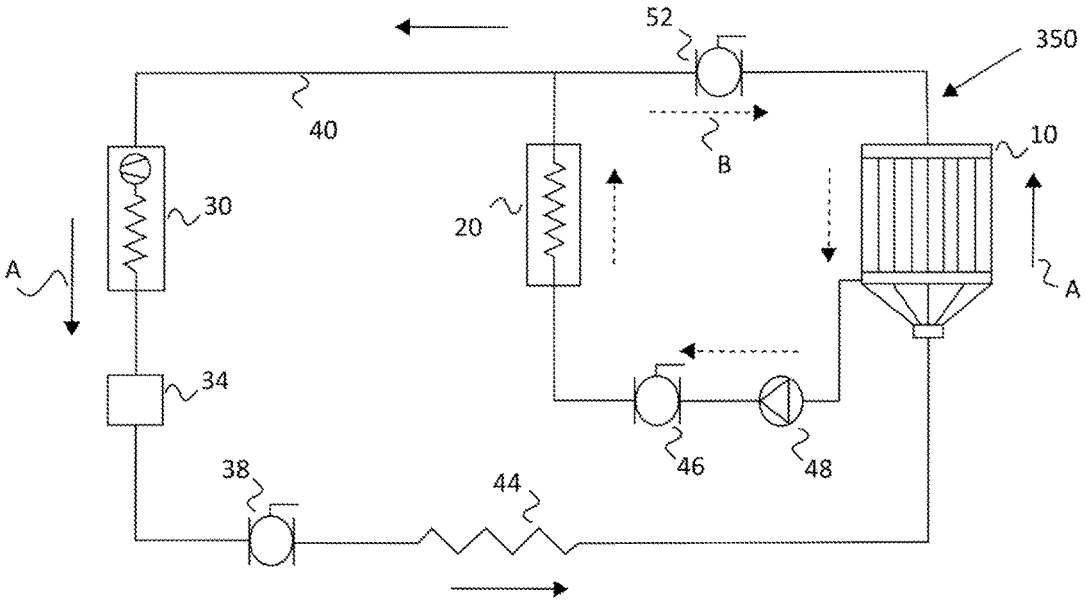

FIGS. 8A and 8B are schematic illustrations of other exemplary cooling systems 300, 350 configured to cool a room (or another enclosed space cooled by the indoor unit 20). While cooling system 100 of FIG. 4 (and systems 200 and 250 of FIGS. 6A and 6B) is configured to cool the room in both the direct mode and the discharge mode, systems 300 and 350 of FIGS. 8A and 8B are configured to cool the room solely in the discharge mode. Eliminating the components (such as, valves, expansion valves, etc.) need to support direct cooling reduces the cost of the cooling systems 300 and 350. Cooling systems 300 and 350 may be ideally suited for applications where direct cooling is not required. For example, in applications where the systems 300, 350 are used as a cooling backup. As described with reference to system 100, systems 300 and 350 may also operate in a charging mode to direct refrigerant 40 between the outdoor unit 30 and the thermal battery 10 (along the path identified by Arrow A) to charge the thermal battery 10, and direct the refrigerant 40 between the thermal battery 10 and the indoor unit 20 (along the path identified by Arrow B) to cool the cooled space. While system 300 of FIG. 8A uses a thermal battery 10 without a distributor, system 350 of FIG. 8B utilizes a fluid distributor 60 upstream of the thermal battery 10 to evenly distribute the chilled refrigerant 40 from the outdoor unit 30 through the pipes of the thermal battery 10. The control system (not shown in FIGS. 8A and 8B) may switch between the charging mode and the discharge mode in a manner similar to that described above with reference to system 100.

Figure 9A:
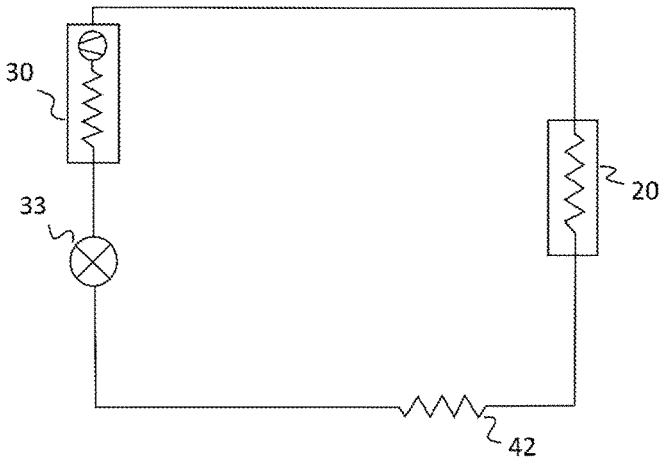
FIGS. 9A-9B are schematic illustrations of an exemplary cooling system of the current disclosure retrofitted to an existing cooling system.
Figure 9B:
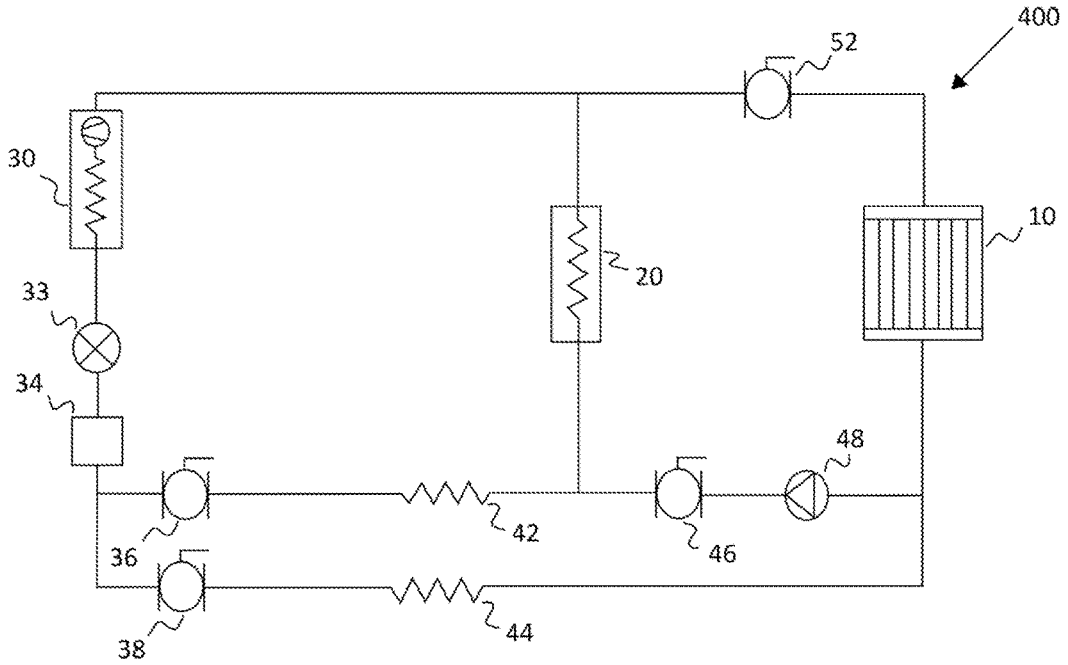

In some embodiments, the cooling systems of the current disclosure may be retrofittable with commercially available cooling units (such as split AC units, bulk milk coolers, cold room coolers, etc.). FIG. 9B is a schematic illustration of an AC system 400 that may be retrofitted to a standard split AC unit illustrated in FIG. 9A. As illustrated in FIG. 9A, a standard split AC unit includes an indoor unit 20 connected to an outdoor unit 30 via a service valve 33. Service valves are standard fluid connectors that enable indoor units 20 and outdoor units 30 to be transported separately and installed at the installation site. Such service valves are commonly present in commercially available cooling systems such as bulk milk coolers, cold room coolers, etc. As illustrated in FIG. 9B, a thermal battery 10 may be coupled to the standard split AC system (of FIG. 9A) via the service valve 33 to result in a system 400 which is architecturally similar to system 100 described with reference to FIG. 4. A control system may then be used to selectively direct refrigerant from the outdoor unit 30 to the indoor unit 20 when energy cost is low, and from the thermal battery 10 to the indoor unit 20 when energy cost is high. Since system 400 of FIG. 9B functions in a manner similar to that of system 100 of FIG. 4, the operation of system 400 is not described in more detail. The ability to retrofit a commercially available cooling system enables cost savings and efficiency improvements to be realized from previously installed cooling systems without having to replace the cooling system.

Figure 10:
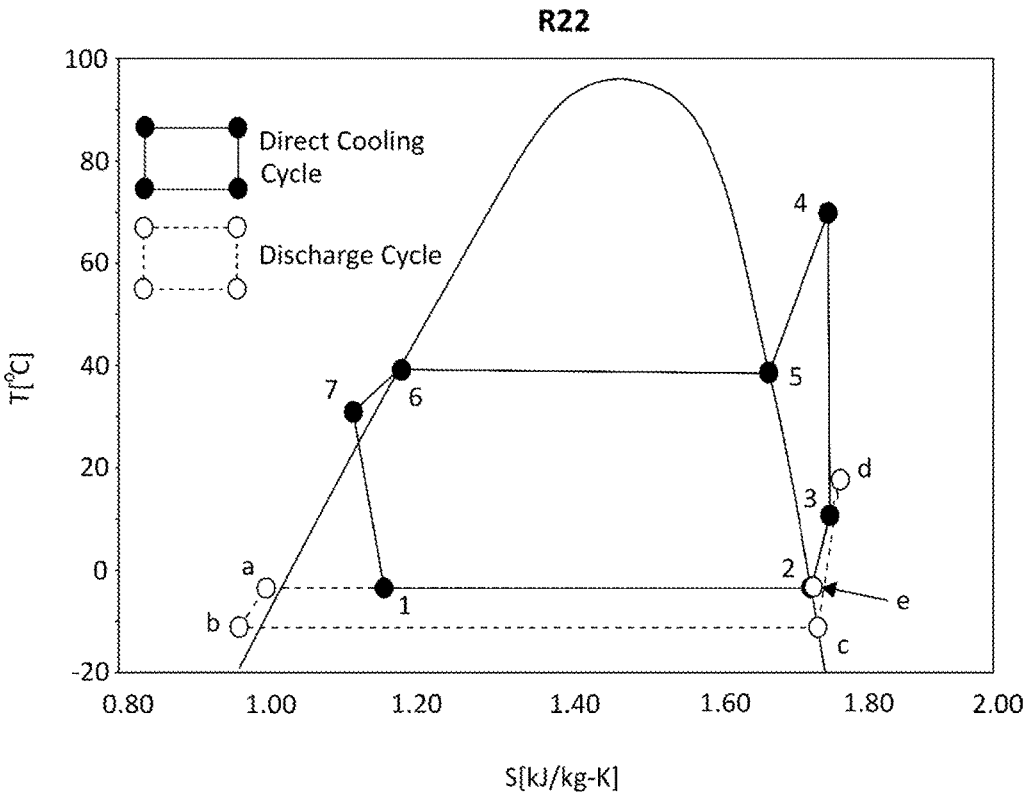
FIG. 10 is a temperature vs. entropy plot of the thermodynamic cycle of an exemplary cooling system of the current disclosure.

FIG. 10 illustrates a thermodynamic cycle of the refrigeration cooling system of FIG. 4 on a traditional T-S (temperature vs. entropy) plot. In FIG. 10, the cooling cycle during the direct cooling mode (solid lines) and the cooling cycle during the discharge mode (dashed lines) are illustrated. The cooling cycle in the charging mode is not shown for clarity sake. The charging mode may be similar to the direct cooling mode, except that expansion valve 44 (see FIG. 4) may create more pressure drop and therefore create a lower temperature at the thermal battery 10 to freeze the coolant 50 in the thermal battery 10.

With reference to FIGS. 4 and 10, in the direct cooling mode (solid lines), between points 3 and 4, the refrigerant 40 is in the compression cycle. Refrigerant 40 in vapor form enters the compressor at point 3 and the compressor compresses the vapor and gets it to higher pressure and temperature (above the ambient temperature) at point 4. Between points 4 and 7, the refrigerant 40 is in the condenser of the outdoor unit 30. This is where the high pressure and high temperature vapor is cooled by ambient temperature air to remove heat from the vaporized refrigerant 40 to convert the vapor back to liquid form. Between points 7 and 1, expansion of the refrigerant 40 occurs in the expansion valve 42 and the high pressure refrigerant in liquid form is throttled to lower pressure so it can be expanded easily. This throttling reduces the temperature of the liquid to below ambient temperature. Between points 1 and 3, the cooled refrigerant (in liquid form) is in the evaporator of the indoor unit 20. In the evaporator, the refrigerant 40, which is below ambient temperature, picks up heat from the air in the room and cools the room air.

During the discharge mode, pump 48 is pumping the liquid refrigerant 40 which goes through the following cycle. From b-a, the refrigerant 40 is in the pump 48. This pump 48 may operate at a significantly lower power (orders of magnitude lower power) than a compressor, and may move the refrigerant 40 (which is near saturated or saturated state) from the thermal battery 10 into the evaporator of the indoor unit 20. From a-e-d, evaporation takes place during the discharging mode and picks up heat from the cooled space. From d-c-b, the refrigerant vapor enters and loses heat to the stored cooled coolant 50 (e.g. ice) and converts into liquid to be pumped back to the evaporator of the indoor unit 20.

It should be noted that, although the disclosed cooling systems are described as air conditioning systems, this is not a limitation. As previously explained, the systems and methods described herein may be applied in to known cooling application. Further, although specific embodiments are described, numerous variations apparent to those of skill in the art are contemplated.

We claim:

1. A cooling system, comprising:
an evaporator unit;
a condensing unit;
a thermal battery fluidly coupled to the evaporator unit and the condensing unit; and
a control system configured to selectively direct a fluid refrigerant between any two of the condensing unit, the evaporator unit, and the thermal battery in at least one of a charging mode, a discharge mode, and a direct cooling mode, wherein
in the charging mode, the refrigerant from the condensing unit flows through the thermal battery only in a first direction,
in the discharge mode, the refrigerant from the evaporator unit flows through the thermal battery in a second direction opposite the first direction, and
in the direct cooling mode, the refrigerant bypasses the thermal battery.

2. The cooling system of claim 1, wherein the control system is configured to direct the refrigerant between the condensing unit and the evaporator unit when energy cost is less than or equal to a threshold cost value.

3. The cooling system of claim 2, wherein the control system is configured to direct the refrigerant between the thermal battery and the evaporator unit when the energy cost is above the threshold cost value.

4. The cooling system of claim 3, wherein, when the energy cost is above the threshold cost value, the control system activates a pump to direct the refrigerant from the thermal battery through the evaporator unit.

5. The cooling system of claim 2, wherein the control system is further configured to direct the refrigerant between the condensing unit and the thermal battery when an ambient temperature of a space cooled by the evaporator unit is less than or equal to a threshold temperature value.

6. The cooling system of claim 1, further including a first expansion device fluidly coupled between the condensing unit and the evaporator unit, and a second expansion device fluidly coupled between the condensing unit and the thermal battery.

7. The cooling system of claim 1, further including a plurality of control valves fluidly coupled to conduits coupling the condensing unit, the evaporator unit, and the thermal battery, wherein the control system is configured to control the plurality of control valves to selectively direct the refrigerant between a selected two of the condensing unit, the evaporator unit, and the thermal battery.

8. The cooling system of claim 1, wherein the cooling system is one of a refrigeration system, air conditioning system, a beverage cooler, and a bulk milk cooler.

9. A method of operating a cooling system, the cooling system including an evaporator unit positioned in a space, a condensing unit, a thermal battery fluidly coupled to the evaporator unit and the condensing unit and a control system configured to operate the cooling system, comprising:
directing a refrigerant from the condensing unit to the evaporator unit when an energy cost is less than or equal to a threshold cost value;

directing the refrigerant from the condensing unit through the thermal battery when an ambient temperature of the space is less than or equal to a threshold temperature value, wherein the refrigerant is directed through the thermal battery such that the refrigerant flows within the thermal battery in only a first direction; and directing the refrigerant from the thermal battery through the evaporator unit when the energy cost is greater than the threshold cost value, wherein the refrigerant is directed from the thermal battery such that the refrigerant flows within the thermal battery in a second direction opposite the first direction.

10. The method of claim 9, wherein directing the refrigerant from the condensing unit through the thermal battery includes freezing the coolant of the thermal battery using the refrigerant from the condensing unit.

11. The method of claim 9, wherein directing the refrigerant from the thermal battery through the evaporator unit includes activating a pump to direct the refrigerant through the evaporator unit.

12. The method of claim 9, further including determining a cooling capacity of the thermal battery, and directing the refrigerant from the thermal battery through the evaporator unit only if the determined cooling capacity is greater than or equal to a threshold cooling capacity.

13. A cooling system, comprising:

an evaporator unit positioned in a cooling space;

a condensing unit;

a thermal battery, the thermal battery including a plurality of conduits extending between a first header and a second header through a coolant;

a fluid refrigerant configured to flow through the evaporator unit, the condensing unit, and the plurality of conduits of the thermal battery in a closed loop;

one or more control valves fluidly coupling the condensing unit, the evaporator unit, and the thermal battery; and a control system configured to control the one or more control valves to selectively direct the refrigerant between (i) the condensing unit and the evaporator unit, (ii) the condensing unit and the thermal battery such that the refrigerant only flows from the second header to the first header in the thermal battery, and (iii) the thermal battery and evaporator unit such that the refrigerant flows from the first header to the second header in the thermal battery, based on at least one of an energy cost and an ambient temperature of the cooling space.

14. The cooling system of claim 13, wherein the control system is configured to direct the refrigerant from the condensing unit to flow through the evaporator unit when the energy cost is less than or equal to a threshold cost value, and direct the refrigerant from the thermal battery to flow through the evaporator unit when the energy cost is above the threshold cost value.

15. The cooling system of claim 14, wherein the control system is further configured to redirect the refrigerant flowing from the condensing unit towards the evaporator unit to flow through the plurality of conduits of the thermal battery when the ambient temperature of the cooling space is less than or equal to a threshold temperature value.

16. The cooling system of claim 15, further including freezing the coolant of the thermal battery using the refrigerant flowing through the plurality of conduits.

17. The cooling system of claim 14, wherein, when the energy cost is above the threshold cost value, the control system activates a pump to direct the refrigerant from the thermal battery to flow through the evaporator unit.

18. The cooling system of claim 14, wherein the control system is configured to determine a cooling capacity of the thermal battery, and direct the refrigerant from the thermal battery to flow through the evaporator unit only if the determined cooling capacity is greater than or equal to a threshold cooling capacity.

19. The cooling system of claim 1, wherein the thermal battery includes a plurality of conduits extending between a first header and a second header through a coolant, and the first direction is from the second header to the first header, and the second direction is from the first header to the second header.

20. The cooling system of claim 13, wherein the cooling system is one of a refrigeration system, an air conditioning system, a beverage cooler, and a bulk milk cooler.

* * * * *